United States Patent [19]

Schwelling

[11] Patent Number: 4,562,971

[45] Date of Patent: Jan. 7, 1986

[54] ROLLER SYSTEM FOR PAPER SHREDDERS

[76] Inventor: Hermann Schwelling, Bahnhofstrasse 115, D-7777 Salem 3/Neufrach, Fed. Rep. of Germany

[21] Appl. No.: 594,238

[22] Filed: Mar. 28, 1984

[30] Foreign Application Priority Data

Mar. 29, 1983 [DE] Fed. Rep. of Germany ..... 3311331

[51] Int. Cl.[4] ..... B02C 18/18

[52] U.S. Cl. ..... 241/236; 241/285 R

[58] Field of Search ..... 241/285 R, 224, 235, 241/236, 166, 167

[56] References Cited

FOREIGN PATENT DOCUMENTS 1563694 3/1980 United Kingdom ..... 241/236

2061128 5/1981 United Kingdom ..... 241/236

517676 9/1976 U.S.S.R. ..... 241/236

*Primary Examiner*—Mark Rosenbaum

*Attorney, Agent, or Firm*—Toren, McGeady, Stanger, Goldberg & Kiel

[57] ABSTRACT

A paper shredder is arranged with a pair of cutting and tearing roller members mounted on bearing members which include semicylindrical recesses within which the roller members are engaged, a pair of support arms which extend from the roller members in the intake direction of the material to be shredded at diverging angles relative to each other, with two pairs of shafts being provided for each of the support arms of the bearing members, the pairs of shafts having longitudinal axes which extend parallel to the axes of the roller members and which are spaced apart a distance taken in the intake direction of the material to be shredded.

7 Claims, 1 Drawing Figure

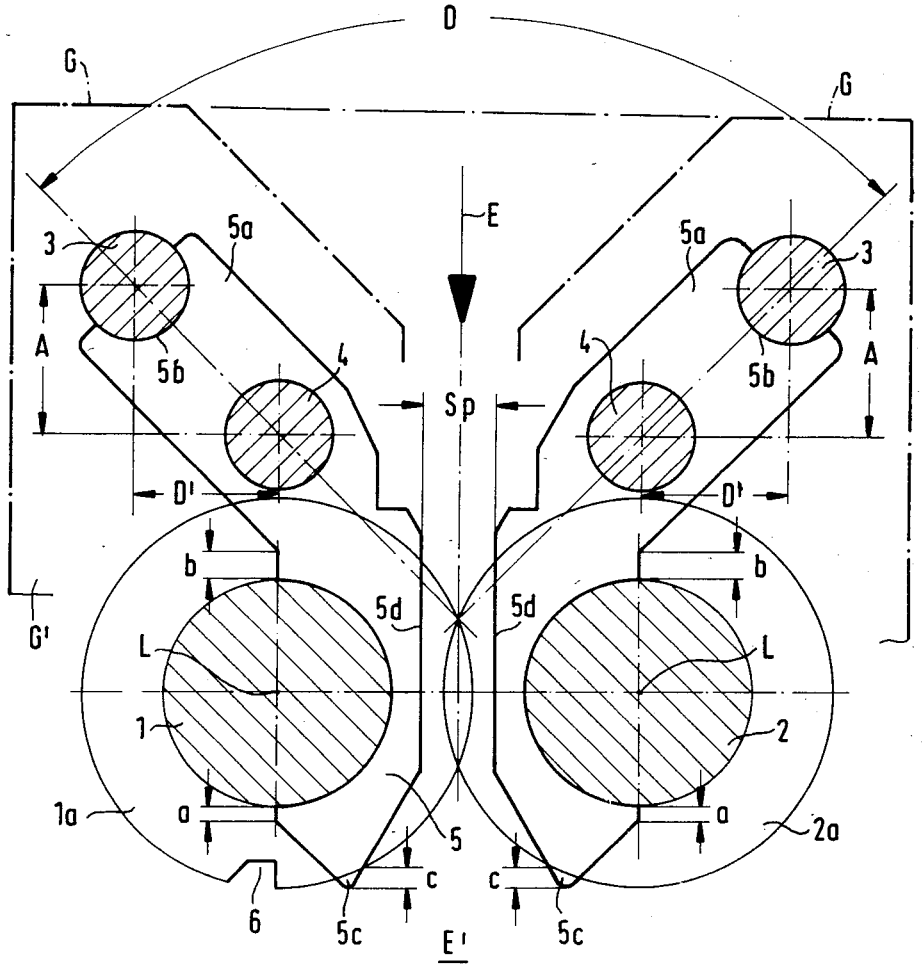
D
G
G
E
3
5a
5a
3
A
5b
4
4
5b
A
Sp
D'
D'
b
b
5d
5d
G'
L
L
1
2
1a
a
a
2a
5
c
c
6
5c
5c
E'

ROLLER SYSTEM FOR PAPER SHREDDERS

The present invention relates generally to shredding apparatus and more particularly to a shredder system for the cutting or tearing rollers of paper shredder machines, particularly the so-called particle cutters wherein longitudinal and transverse separation of the material to be shredded is achieved.

Devices of the type to which the present invention relates generally consist of individual profile sections or pieces arranged one behind the other and held in position by means of at least two common or shared bearing bars. The arrangement is such that it extends in the longitudinal direction of rollers which operate to tear or shred material and the arrangement is such that the pairs of shredder units are positioned in a mirror-inverted manner relative to each other.

In particle cutters of the type to which the present invention relates, problems may arise in practice in that paper particles, which may generally be between 2 and 15 mm long, may accumulate and agglomerate at edges or corners of the device, and particularly between the cutting discs of the apparatus and the lower support bars for the shredders on the output side of the paper shredding device. As a result of such clogging or agglomeration of the material to be shredded, performance will decline, cutting will not be as effective and sometimes complete blockage or stoppage of operation may result from the accumulation of the treated material.

Accordingly, the present invention is directed toward providing a shredder system for devices of the type described above wherein the shredder system may be simply constructed, easily assembled and attached and arranged in its total or overall configuration such that in addition to the capability for effecting clean shredding operation both in the forward and in the momentary reverse operation of the machine, there will be avoided structural component parts which could cause or enhance clogging or stopping of the machine.

SUMMARY OF THE INVENTION

Briefly, the present invention may be defined as shredder apparatus for cutting and tearing material such as paper or the like comprising a pair of cutting and tearing roller members having longitudinal axes extending parallel to each other and spaced apart to define therebetween an intake gap through which material to be shredded may be introduced into said shredder apparatus in an intake direction and a pair of bearing support members supporting said roller members, said bearing support members comprising roller engaging portions having semicylindrical recesses therein within which said roller members are respectively supported, a pair of support arms extending from said roller members in said intake direction and two pairs of shafts one supporting each of said support arms, each of said pairs of shafts having longitudinal axes which extend parallel to said longitudinal axes of said roller members and which are spaced apart a distance taken in said intake direction.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DESCRIPTION OF THE DRAWING

The single FIGURE of drawing is a sectional view depicting paper shredding apparatus constituting an embodiment of the present invention.

DETAILED DESCRIPTION OF THE PREFERRED EMBODIMENT

Referring now to the drawing there is shown a system for arranging and supporting the cutting and tearing rollers of a shredder apparatus particularly suitable tearing and shredding paper wherein a pair of roller members 1 and 2 each having a longitudinal axis L are arranged in side by side relationship with their axes L parallel and spaced apart to define a material intake gap $S_p$ therebetween through which material to be shredded may be introduced into the shredder apparatus in an intake direction E.

Each of the roller members 1 and 2 include a cutting disc 1*a*, 2*a* respectively with the cutting discs having defined therein cutting teeth 6.

The roller assemblies are mounted on a housing G shown schematically in dash-dot form by means of a pair of bearing support members 5 each of which is arranged to support one of the roller members 1, 2.

Each of the bearing support members 5 is formed with a support arm 5*a* extending from the roller members 1, 2 toward the intake direction E in a diverging pattern. The support arms 5*a* include central axes which are arranged at an angle D relative to each other.

Each of the support arms 5*a* is mounted upon a pair of shafts 3 and 4 having longitudinal axes parallel to each other and parallel to the axes L of the roller members 1, 2 with each support arm 5*a* being mounted on a pair of shafts 3, 4. Each pair of shafts 3, 4 is arranged with their axes spaced apart a distance A, a dimension which extends parallel to the intake direction E, and spaced apart a distance $D_1$ which is a dimension extending perpendicular to the intake direction E.

The roller members 1, 2 are mounted upon semicircular recesses formed in the bearing support members 5.

By means of a further construction feature of the invention, and for the purpose of enabling easier assembly of the shredder system of the invention, the mechanism shown in the drawing is arranged so that the holding or support shafts 4 are arranged to extend through the support arms 5*a* of the bearing support members 5 and so that the support shafts 3, which are arranged forwardly or upstream of the support shafts 4, taken in the intake direction E are inserted in semicircular or semicylindrical cutout portions or recesses 5*b* formed at the end faces of the support arms 5*a*. As a result, the bearing support members 5 and the support shafts 3 and 4 may be easily inserted, adjusted and aligned and anchored within side parts G′ of the housing or machine frame G during assembly.

A particular advantage of the arrangement of the present invention consists in that, first of all, there no longer are any machine parts on the output side of the apparatus at or between which paper particles could pile up or settle. At the same time, favorable and prompt shredding of the material to be shredded by the shredder assembly will be achieved and proper functioning as a result of the semicylindrical construction of the shredder apparatus starting from the conveyor gap $S_p$ is preserved in that lever arms A and D′ in the support shafts 3 and 4 at the head side provide for sufficient stability and reception or absorption of force so that the semicylindrical parts of the bearing support members 5 will always be aligned exactly relative to the respective roller members 1 and 2 during forward and reverse operation.

In sure cutting of cut particles, as well as of particles which may continue to adhere to the parts of the machine, will be effected during forward and reverse operation of the rollers 1, 2 and such appropriate operation is achieved in that transition zones a and b are provided which extend from the semicylindrically shaped recesses of the bearing support members 5. Furthermore, the bearing support members 5 are formed with linearly arranged or straight back parts 5*d* between which the intake gap $S_p$ is defined and with three shredder ends 5*c*. As a result of the cooperation, structure and arrangement of the linear backs or sides 5*d* and the forwardly projecting three shredder ends 5*c* of the bearing support members 5, the free ends 5*c* of the shredder will project outwardly of the shredder cutting limits defined by the cutting discs 1*a* and 2*a* by a distance c.

Thus, with the back parts 5*d* defining the intake gap $S_p$, the free ends 5*c* of the bearing support members 5 will project out of the cutting disc boundaries by a distance c, specifically, with approximately the same inclination and the same adjusting or clearance angle at both sides relative to the circumferences of the cutting discs 1*a* and 2*a* respectively.

Thus, from the foregoing it will be seen that the present invention provides a shredder system for the disc parts 1*a* and 2*a* of the cutting and tearing rollers 1 and 2 of paper shredding machines, which disc parts 1*a* and 2*a* are provided with grooves or teeth 6, the shredders being provided wtih bearing support members 5 which, as seen from the conveyor or intake gap $S_p$, comprise the respective roller members 1 and 2 withing a semicylindrically shaped recess with holding or support shafts 3 and 4 extending in the longitudinal direction of the axes L of the rollers serving to support the bearing support members 5. The holding or support shafts 3 and 4, are arranged at a reciprocal axial distance A and diverge from the intake gap $S_p$ with an angle D therebetween, the shafts extending through respective bearing support member support arms 5*a* which are fastened in the housing G at housing side parts G'.

Of course, the bearing support members 5 also operate as shredders and the support shafts 3 and 4 together with the respective support arms 5*a* of the shredder profiles 5, as seen from the conveyor gap $S_p$, have a coarse shape or progression D which diverges in the intake direction E.

The support shaft 4 which is, respectively, adjacent to one of the disc parts 1*a* and 2*a*, respectively, of the roller members 1 and 2, respectively, extends through a respective shredder support arm or head part 5*a* while the arms 3, which are arranged forwardly or upstream thereof taken in the intake direction E, are inserted in semicircular cutout portions 5*b* at the front sides of the shredder head parts or support arms 5*a*.

The invention is further characterized in that the transition zones a and b extend from the semicylindrically shaped shredder area 5 to the shredder head part 5*a* and toward the respective free shredder end 5*c* linearly as well as parallel relative to the linear back parts 5*d* of the semicylindrically shaped areas 5, which back parts 5*d* define the intake gap $S_p$.

The invention is further characterized in that the free ends 5*c* of the shredders 5 project from the cutting disc boundaries 1*a* and 2*a* by a slight distance c.

While a specific embodiment of the invention has been shown and described in detail to illustrate the application of the inventive principles, it will be understood that the invention may be embodied otherwise without departing from such principles.

What is claimed is:

1. Shredder apparatus for cutting and tearing material such as paper or the like comprising: a pair of cutting and tearing roller members having longitudinal axes extending parallel to each other and spaced apart to define therebetween an intake through which material to be shredded may be introduced into said shredder in an intake direction; and a pair of shredder bearing support members supporting said roller members, said shredder bearing support members comprising roller engaging portions having semicylindrical recesses therein within which said roller members are respectively supported, said semicircular recess opening in diametrically opposed directions facing away from said intake gap, a pair of shredder support arms extending from said roller members in said intake direction and two pairs of support shafts, one supporting each of said support arms, each of said pairs of shafts having longitudinal axes which extend parallel to said longitudinal axes of said roller members and which are spaced apart a distance A taken in said intake direction, each of said roller members comprising a cutting disc having a generally circular circumference and wherein each of said shredder bearing support members comprise a free end extending forwardly on the output side of said shedder apparatus in the feed direction of the material passing through said shredder apparatus, said free ends extending beyond the boundaries of said circumference of said cutting discs by a slight distance with a pointed shape.

2. Apparatus according to claim 1 wherein said support arms are arranged to extend in diverging directions taken relative to said intake direction.

3. Apparatus according to claim 1 wherein said longitudinal axes of said two pairs of shafts are arranged to lie along divergent lines taken relative to said intake direction.

4. Apparatus according to claim 1 wherein each of said pairs of shafts is arranged with their axes spaced apart taken in the direction perpendicular to said intake direction.

5. Apparatus according to claim 1 wherein each of said pairs of shafts includes a forwardmost shaft and a rearmost shaft taken relative to said intake direction with said rearmost shaft lying upstream of said forwardmost shaft taken in said intake direction, said forwardmost shaft being arranged to extend completely through said respective support arm with said rearmost shaft being inserted in a semicircular cutout portion at the upstream end of said support arm.

6. Apparatus according to claim 1, wherein said shredder bearing support members are arranged to define transition zones which extend from said semicylindrical recesses toward said support arms and toward said respective free shredder ends.

7. Apparatus according to claim 1 wherein said shredder bearing support members are arranged to define a pair of linear back parts which define therebetween said intake gap and which extend parallel to each other in facing relationship in said intake direction.

* * * * *